US012285085B1

(12) United States Patent
Proulx et al.

(10) Patent No.: US 12,285,085 B1
(45) Date of Patent: Apr. 29, 2025

(54) JEWELRY ITEM

(71) Applicants: Elizabeth Proulx, Attleboro, MA (US); Melanie Indindoli, Rehoboth, MA (US)

(72) Inventors: Elizabeth Proulx, Attleboro, MA (US); Melanie Indindoli, Rehoboth, MA (US)

( * ) Notice: Subject to any disclaimer, the term of this patent is extended or adjusted under 35 U.S.C. 154(b) by 0 days.

(21) Appl. No.: 18/370,164

(22) Filed: Sep. 19, 2023

(51) Int. Cl.
*A44C 27/00* (2006.01)
*A44C 5/02* (2006.01)

(52) U.S. Cl.
CPC ..... *A44C 5/025* (2013.01)

(58) Field of Classification Search
CPC ..... A44C 15/005; A44C 5/022; A44C 5/027; A44C 5/025
See application file for complete search history.

(56) References Cited

U.S. PATENT DOCUMENTS

| | | | | |
|---|---|---|---|---|
| 1,694,703 | A * | 12/1928 | Doppenschmitt | A44C 5/025 63/3 |
| 8,281,465 | B1 | 10/2012 | Miraldi | |
| 8,449,299 | B1 * | 5/2013 | Sheeley | G09B 19/02 434/203 |
| 9,676,008 | B1 | 6/2017 | Huang | |
| 10,342,302 | B2 | 7/2019 | Clark | |
| 10,380,734 | B2 | 8/2019 | Parikh et al. | |
| 10,573,153 | B1 | 2/2020 | Woodward et al. | |
| 10,825,166 | B2 | 11/2020 | Parikh et al. | |
| D914,531 | S * | 3/2021 | Winston | D11/6 |
| 11,147,511 | B1 | 10/2021 | Mitogo | |
| 11,232,553 | B2 | 1/2022 | Parikh et al. | |
| 2003/0136149 | A1 * | 7/2003 | Logan | A44C 11/002 63/38 |
| 2003/0144602 | A1 * | 7/2003 | Jennings | A61B 10/0012 600/551 |
| 2006/0004252 | A1 * | 1/2006 | Astala | A44C 25/00 63/11 |
| 2009/0255295 | A1 * | 10/2009 | Lane | A44C 11/002 63/3 |
| 2015/0352890 | A1 * | 12/2015 | Le | B43K 29/004 401/88 |

OTHER PUBLICATIONS

"Gene sequence bracelet activity," American Society for Biochemistry and Molecular Biology, https://www.asbmb.org/education/science-outreach/gene-sequence-bracelets.

* cited by examiner

*Primary Examiner* — Jack W Lavinder
(74) *Attorney, Agent, or Firm* — Salter & Michaelson

(57) ABSTRACT

A jewelry item that includes a plurality of separate links that are supported by a common substrate and in which the links are representative of the DNA lineage of the wearer of the jewelry item. The DNA lineage is represented by the predetermined percentage of DNA on a country-by-country basis as obtained for the wearer; the predetermined percentage being represented by respective different colors that identify each predetermined percentage of DNA. The separate links are in the colors corresponding to the predetermined percentage for each link.

10 Claims, 4 Drawing Sheets

JEWELRY ITEM

FIELD OF THE INVENTION

The present invention relates in general to a jewelry item. More particularly the present invention relates to an improved jewelry item that can be embodied as a bracelet, necklace, finger ring or earring. Even more particularly the present invention pertains to a jewelry item in which the item is formed by a plurality of separate links that may be in the form of multi-color beads.

BACKGROUND OF THE INVENTION

Jewelry items such as bracelets and necklaces exist where several beads or links may be supported on a substrate which may be a filament or string that carries the beads or links. These bracelets and necklaces may have different colors to the beads or links, but the colors do not relate at all to the particular wearer or user and would usually just be random in nature.

Accordingly, it is an object of the present invention to provide an improved jewelry item where the colors of beads or links relate in particular to the person that is wearing the jewelry item.

Another object of the present invention to provide an improved jewelry item where the colors of beads or links relate, not only to the person that is wearing the jewelry item, but are linked by the DNA of the person.

Still another object of the present invention to provide an improved jewelry item where the colors of beads or links are representative of the DNA lineage of the wearer of the jewelry item.

SUMMARY OF THE INVENTION

In accordance with the present invention there is provided a jewelry item that is comprised of a plurality of separate links that are supported by a common substrate and in which the links are representative of the DNA lineage of the wearer of the jewelry item. The DNA lineage is represented by the predetermined percentage of DNA on a country by country basis as obtained for the wearer. The predetermined percentage is represented by respective different colors that identify each predetermined percentage of DNA; and including on the substrate of the jewelry item the separate links in the colors corresponding to the predetermined percentage for each link.

In accordance with other aspects of the present invention for smaller predetermined percentages a single link is used; for larger predetermined percentages multiple links are used; for smaller predetermined percentages a single link is used, and for larger predetermined percentages multiple links are used; wherein all links that comprise the jewelry item have the same length; wherein all links are engaged from one to the next; wherein each link comprises a bead; wherein the substrate comprises an elongated filament forming a bracelet; wherein the filament is stretchable; and wherein the substrate is one of an earring base, a bracelet, a necklace and a ring.

In accordance with another version of the present invention there is provided a method of forming a jewelry item that is comprised of a plurality of separate links, supporting the separate links by means of a common substrate, representing the links in the form of the DNA lineage of the wearer of the jewelry item; representing the DNA lineage by the predetermined percentage of DNA, on a country by country basis, as obtained for the wearer. The predetermined percentage is represented by respective different colors that identify each predetermined percentage of DNA; and including on the substrate of the jewelry item the separate links in the colors corresponding to the predetermined percentage for each link.

In accordance with still other aspects of the present invention for smaller predetermined percentages, using a single link; for larger predetermined percentages, using multiple links; for smaller predetermined percentages using a single link, and for larger predetermined percentages using multiple links; providing all links that comprise the jewelry item to have the same length; engaging all links from one to the next; providing each link as a bead; providing the substrate as an elongated filament forming a bracelet; wherein the filament is stretchable; and wherein the substrate is one of an earring base, a bracelet, a necklace and a ring.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
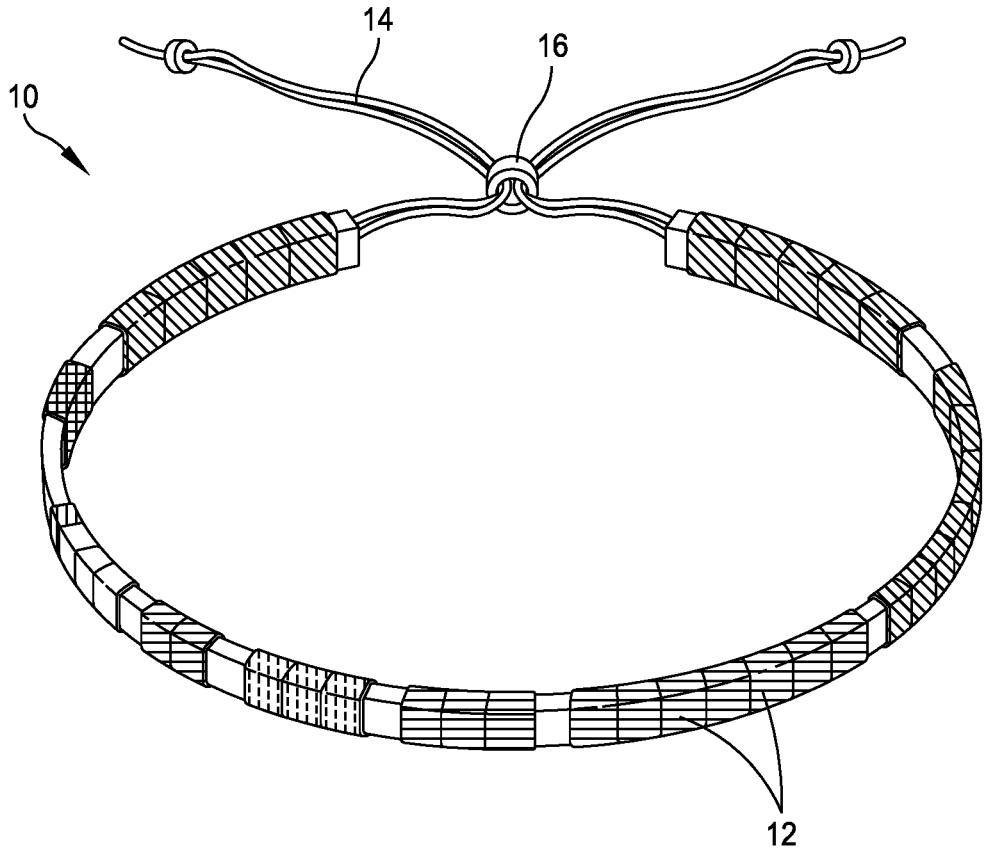
FIG. 1 is a perspective view of the jewelry item of the present invention in the form of a bracelet.
Figure 2:
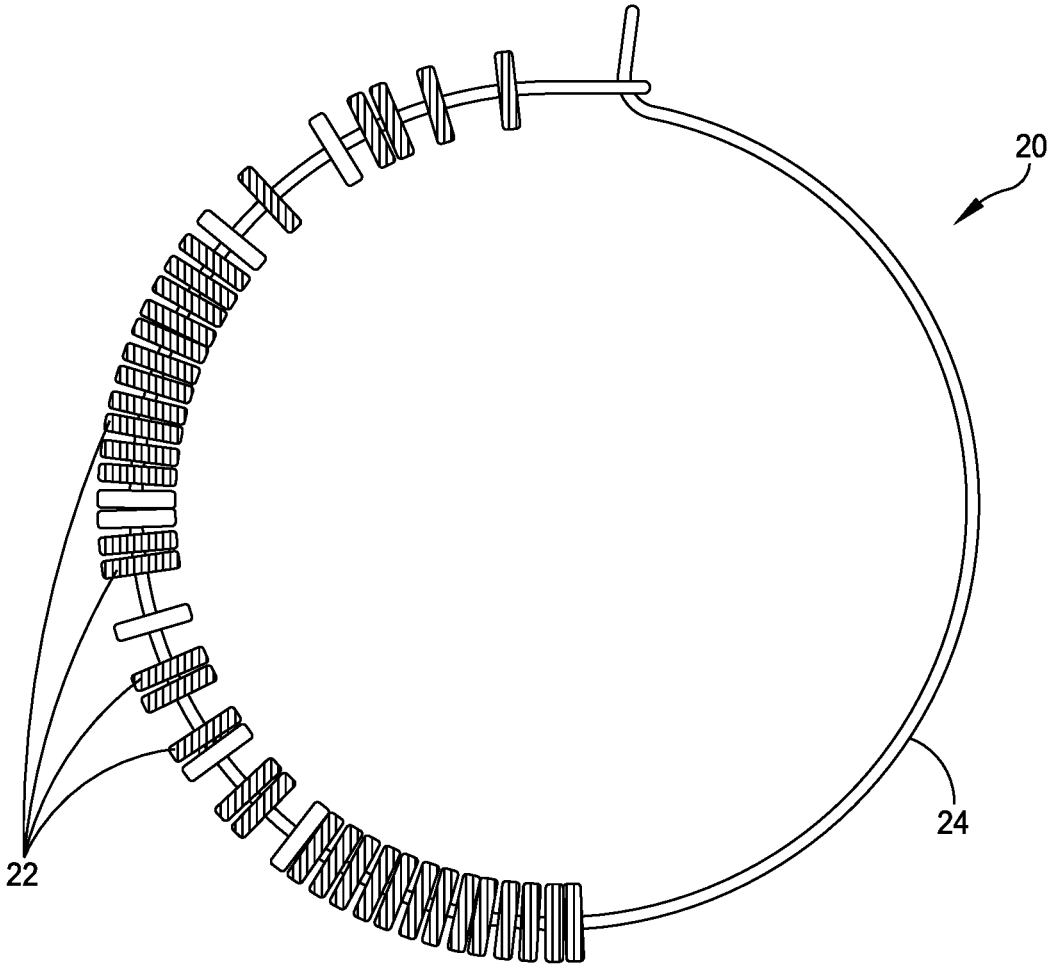
FIG. 2 is a plan view of the jewelry item of the present invention in the form of a hoop earring.
Figure 3:
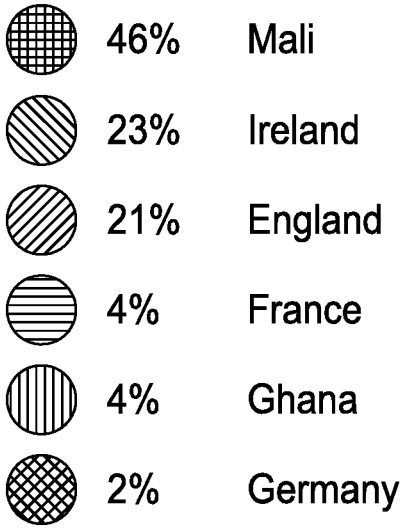
FIG. 3 is a listing by country and percentage of a representative DNA sample.
Figure 4:
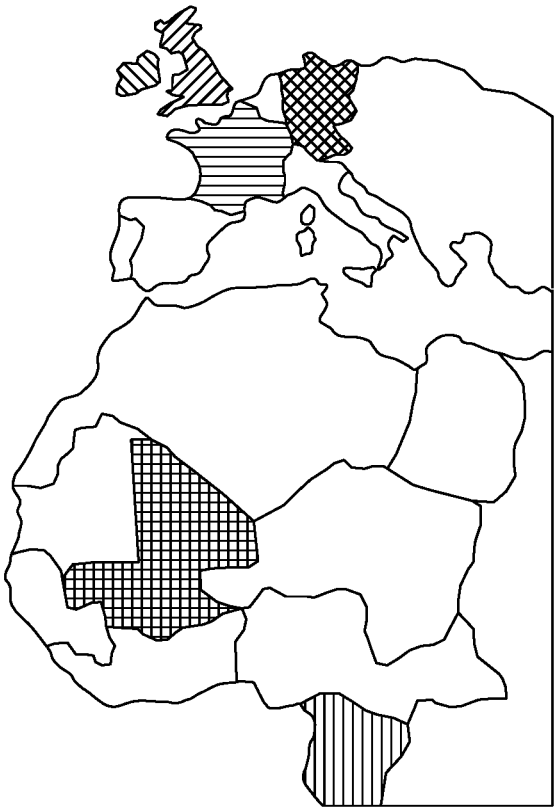
FIG. 4 is a diagram of a section of the world corresponding to the list of FIG. 3.
Figure 5:
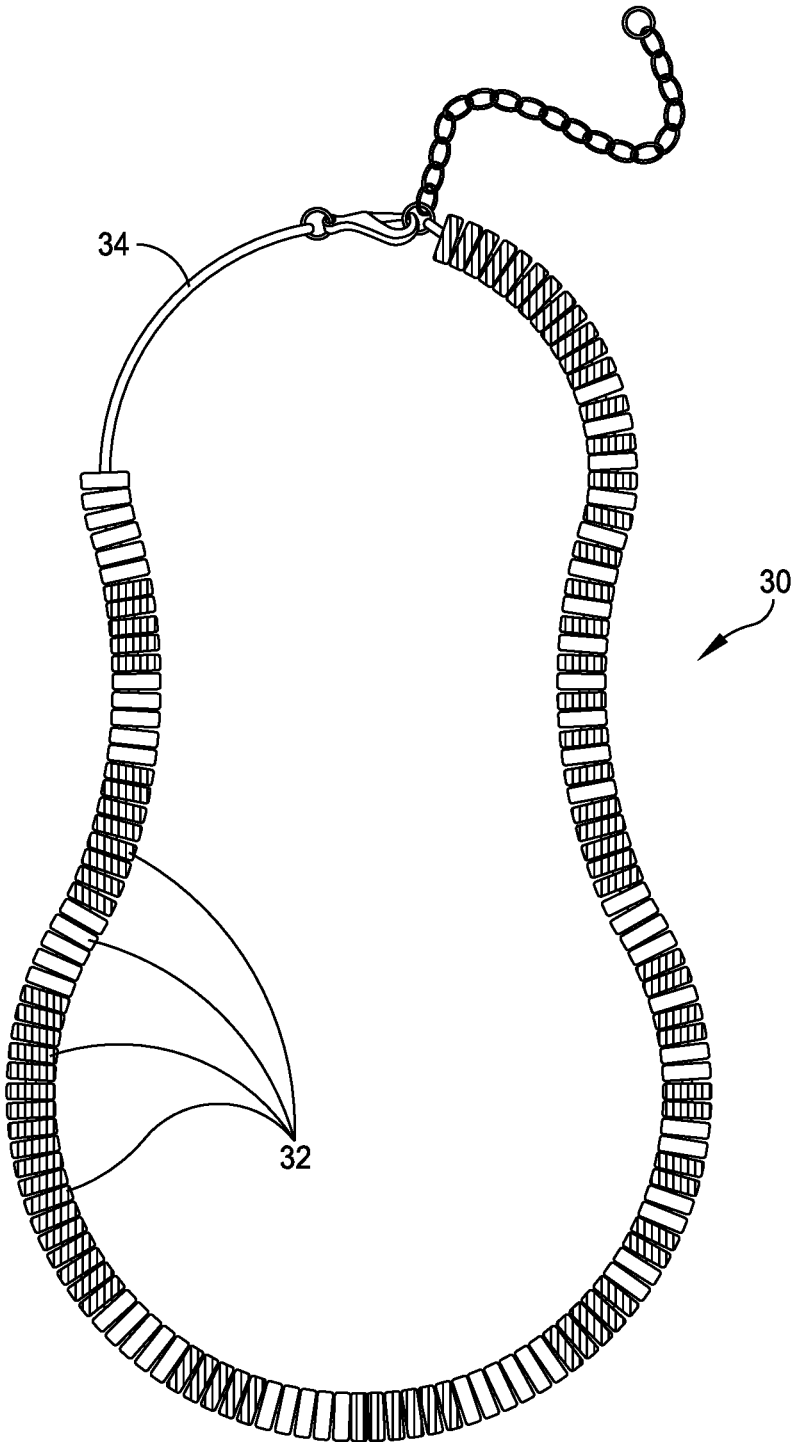
FIG. 5 is a perspective view of the jewelry item of the present invention in the form of a necklace.

Reference is now made to the drawings herein that show several embodiments of the jewelry item of the present invention. The several embodiments include a bracelet, necklace, earring and ring. FIG. 1 is a perspective view of the jewelry item of the present invention in the form of a bracelet. FIG. 2 is a plan view of the jewelry item of the present invention in the form of a hoop earring. FIG. 3 is a listing by country and percentage of a representative DNA sample. FIG. 4 is a diagram of a section of the world corresponding to the list of FIG. 3. FIG. 5 is a perspective view of the jewelry item of the present invention in the form of a necklace.

In one embodiment of the present invention as illustrated in FIG. 1, there is provided a customized and personalized bracelet. In FIG. 1 there is shown the bracelet 10 with separate beads or links 12 that are thread onto filament 14 with a slider mechanism 16 disposed between the filament ends. The slider mechanism can adjust the size of the bracelet to fit the users wrist. The filament 14 may either be stretchable or not. The entire process of forming the bracelet starts with the customer send in their DNA results showing their ancestry which coordinates with certain colors of the globe. All personalized information such as name, age, etc is irrelevant and not absolutely needed. The DNA results can be acquired from kits sold by sites like AncestryDNA, 23 and Me, and many more.

Reference is now made to FIG. 2 which is a plan view of the jewelry item of the present invention in the form of a hoop earring 20. In this embodiment the hoop earring is comprised of a series of links or beads 22 of varied colors. In this particular embodiment each of the beads 22 had the same width. The links or beads 22 are supported by the loop filament 24. Reference is now made to FIG. 5 which is a perspective view of the jewelry item of the present invention in the form of a necklace 30. In this embodiment the necklace is comprised of a series of links or beads 32 of varied colors. The links or beads 32 are supported by the necklace filament 34.

Reference is now made to the chart in FIG. 3 that shows one DNA result that was submitted by a customer. This chart shows the respective country percentages based on world locations; particularly based on individual countries (or world regions) as set forth in FIG. 3. The color blocking size and pattern is determined by the percentage of that country or region. Each person's bracelet is thus as unique as their DNA. The number of beads in a group thus corresponds to the percentage for that country or region. For simplicity, we have set forth only identification by country. The following are the countries and percentages in each country:

46% Mali—Yellow bead;
23% Ireland—Green bead;
21% England—Red bead;
4% France—Blue bead;
4% Ghana—Orange bead; and
2% German—Purple bead.

This particular sample would be almost half "yellow" beads (46%) and the second largest color block would be the "green" beads (23%) for Ireland, et sic porro. If all of the individual beads are of the same width, as in FIG. 2 then there are twice as many "yellow" beads as there are "green" beads (46% versus 23%).

In one embodiment the beads may be a Tila bead Style A) strung on cotton thread/cord held together with a sliding bead closure. Style B) strung on an elastic stretch cord. In addition to using beads that are all of the same width (by "width" reference is made to the direction along the filament when assembled), it is expected that different width beads may be employed. For example, in the above chart for the "yellow" and "green" beads; the "yellow" bead may comprise two equal width beads; while the "green" bead may comprise a single bead. This arrangement also meets the requirement of 46% versus 23%. In another example in accordance with the present invention the "yellow" bead may a single bead of length X; while the "green" bead may also be a single bead but of width X/2. This arrangement also meets the requirement of 46% versus 23%. In other words, in order to properly represent the person's DNA the total width of each bead section has to correspond to the respective percentages, and regardless of bead widths.

Reference may now also be made to FIG. 4, which is a diagram that matches the colors of FIG. 3 with the world locations. Thus, in FIG. 4 for the country of *Mali*, shown in "yellow" in FIG. 3, the corresponding "yellow" color also denotes the country of *Mali* in Africa on the world map. Also, in the chart of FIG. 3 the Applicant has used designated cross-hatching to indicate each of the colors.

In accordance with the present invention there is also provided method of forming a jewelry item that is comprised of a plurality of separate links, supporting the separate links by means of a common substrate, representing the links in the form of the DNA lineage of the wearer of the jewelry item; representing the DNA lineage by the predetermined percentage of DNA, on a country-by-country basis, as obtained for the wearer. The predetermined percentage is represented by respective different colors that identify each predetermined percentage of DNA; and including on the substrate of the jewelry item the separate links in the colors corresponding to the predetermined percentage for each link or block.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A method of forming a jewelry item that is comprised of a plurality of separate links, supporting the plurality of separate links by means of a common substrate, representing the plurality of separate links in a form of a DNA lineage of a wearer of the jewelry item; representing the DNA lineage by a plurality of predetermined percentages of DNA, on a country by country basis, as obtained for the wearer; each of the plurality of the predetermined percentages of DNA being represented by a different color link of the plurality of separate links and in respective link groups corresponding to a respective country; a total width of each of the respective link groups corresponding to the predetermined percentage of DNA of the respective country and including on the common substrate of the jewelry item all of the link groups defining the DNA lineage of a wearer of the jewelry item.

2. The method of claim 1 wherein, for a smaller predetermined percentage of DNA, using a single link.

3. The method of claim 1 wherein, for a larger predetermined percentage of DNA, using multiple links.

4. The method of claim 1 wherein, for a smaller predetermined percentage of DNA using a single link, and for a larger predetermined percentage of DNA using multiple links.

5. The method of claim 1 including providing the plurality of separate links that comprise the jewelry item to have a same length.

6. The method of claim 1 including engaging the plurality of separate links from one to a next.

7. The method of claim 1 including providing each of the plurality of separate links as a bead.

8. The method of claim 1 including providing the common substrate as an elongated filament forming a bracelet.

9. The method of claim 8 wherein the elongated filament is stretchable.

10. The method of claim 1 wherein the common substrate is one of an earring base, a bracelet, a necklace and a ring.

* * * * *